US005865556A

United States Patent [19]

Lhuisset

[11] Patent Number: 5,865,556

[45] Date of Patent: Feb. 2, 1999

[54] BRUSH FOR THE APPLICATION OF A LIQUID, PASTY OR POWDERY PRODUCT SUCH AS MASCARA

[75] Inventor: François Noël Benoît Lhuisset, Montgeron, France

[73] Assignee: LVMH Recherche, Nanterre, France

[21] Appl. No.: 860,458

[22] PCT Filed: Dec. 26, 1995

[86] PCT No.: PCT/FR95/01734

§ 371 Date: Oct. 1, 1997

§ 102(e) Date: Oct. 1, 1997

[87] PCT Pub. No.: WO96/19930

PCT Pub. Date: Jul. 4, 1996

[30] Foreign Application Priority Data

Dec. 27, 1994 [FR] France ..... 94 15718

[51] Int. Cl.[6] ..... A46B 11/02

[52] U.S. Cl. ..... 401/290; 132/218; 401/129; 401/282; 401/284; 401/288

[58] Field of Search ..... 401/129, 282, 401/284, 286, 288, 290; 132/218

[56] References Cited

U.S. PATENT DOCUMENTS

| | | | |
|---|---|---|---|
| 1,130,442 | 3/1915 | Speese | 401/290 X |
| 3,343,551 | 9/1967 | Anderson | 132/218 |
| 3,908,676 | 9/1975 | Levine et al. | 132/218 |
| 4,662,385 | 5/1987 | Schefer | 132/218 |

FOREIGN PATENT DOCUMENTS

| | | |
|---|---|---|
| 0 530 837 | 3/1993 | European Pat. Off. . |
| 93 16 562 | 1/1994 | Germany . |
| 1 465 458 | 2/1977 | United Kingdom . |
| 2 074 443 | 11/1981 | United Kingdom . |

*Primary Examiner*—Steven A. Bratlie
*Attorney, Agent, or Firm*—Pennie & Edmonds LLP

[57] ABSTRACT

A brush for applying a given kind of material is disclosed. The brush has an operative portion consisting of a tube split along at least one generatrix and containing at least one insert surrounded by flexible filaments held in place by means of a sleeve, and the free ends of the filaments project out of the slit in the tube to form the brush bristles. The brush enables, inter alia, the application of mascara onto eyelashes.

10 Claims, 2 Drawing Sheets

4
1
2
3
5

3
3
8a
8a
10a
7
10a
8
6
2
10
9

3
13a
7
6
13
7
7
3
13a 3
3
6
14b
7
12a
12b
14a
12
11

11
7a
6
7
2

3
3
7
8a
8a
8
2
6
15

BRUSH FOR THE APPLICATION OF A LIQUID, PASTY OR POWDERY PRODUCT SUCH AS MASCARA

BACKGROUND OF THE INVENTION

The present invention has essentially as its subject a brush for the application of a liquid, pasty or powdery product of any nature, such for example as mascara.

SUMMARY OF THE INVENTION

One has already proposed brush structures the bristles of which are distributed in a more or less random manner over their support. Thus, the application of the product to be effected with the brush may not be very precise or pinpoint-like, which represents an inconvenience notably in the case where it is a matter of applying mascara onto eyelashes. In effect, in such a case, mascara should be applied as close as possible to the root of the lash.

Moreover with the current mascara brushes comprising a more or less random distribution of the bristles, the product tends to accumulate in the manner of pies on certain zones of the brush and notably at the end thereof, thereby of course making difficult a precise and homogenous application of the product.

Therefore, the present invention has as its object to remedy these inconveniences as well as others by proposing a brush with a particular design permitting a precise, effective and homogenous application of the product to be applied.

For that purpose, the invention has as its subject a brush for the application of any liquid, pasty or powdery product such as mascara for example and of the type comprising a stem or the like carrying one or several rows of bristles along at least one generatrix, characterized in that this stem is a tube split along at least one generatrix and in which is accommodated at least one insert around which are applied flexible filaments the free ends of which project from the slit of the tube to thus constitute the bristles of the brush.

According to a preferred embodiment, the aforesaid filaments are held around the insert by a split envelope interposed between the insert and the tube.

The insert could exhibit substantially the shape of a split cylinder the mutually facing free edges of which project from the slit of the tube to constitute bearing and orientation surfaces for the bristles.

One therefore understands that the bristles of the brush will be organized and positively held by the free edges of the insert in two sheets of bristles permitting a homogenous retaining of the product and an application thereof with precision.

According to another embodiment, the insert exhibits the shape of a T-like piece the vertical leg of which projects from the slit of the tube.

This slit preferably exhibits a trapezoidal shape diverging towards the free end of the tube which will be closed by a plug.

One should further specify here that the aforesaid envelope exhibits substantially the shape of a split cylinder the mutually confronting edges of which project from the slit of the tube.

Thus the bristles of the brush projecting from the slit of the tube will advantageously be clamped between the free edges of the insert and the free edges of the tube.

According to another characteristic of this brush, the tube is closed at its free end by a plug.

One should further specify here that the brush comprises two lugs made fast to the plug and to the tube, respectively, for closing the side ends of the rows of bristles above the slit of the tube.

The brush according to this invention is further characterized by the fact that the aforesaid tube is connected to a handle stick forming a tank for the product to be applied such as mascara for example.

According to another embodiment, the aforesaid tube is connected to a handle stick or itself forms a handle for gripping the brush and is associated with a plug or the like for the protection of the brush forming a tank for the product in which the brush is dipped.

It should be noted that the aforesaid gripping handle could form a tank for a liquid for the dilution of the product contained in the protective plug of the brush.

According to still another embodiment, the tube is connected to a handle stick forming a mascara tank and the insert assumes the shape of a split cylinder the mutually facing free edges of which are projecting from the slit of the tube to constitute surfaces between which project the bristles which are set inside of the insert substantially oppositely to and plumb with the said free edges.

One should specify that the bristles are preferably set onto a plate or the like made fast to the internal wall of the insert.

BRIEF DESCRIPTION OF THE DRAWINGS

But further characteristics and advantages of the invention will appear better in the detailed description which follows and refers to the attached drawings given by way of example only and in which.

DETAILED DESCRIPTION OF THE PREFERRED EMBODIMENTS

Figures 1, 2, 3, 4, 5:
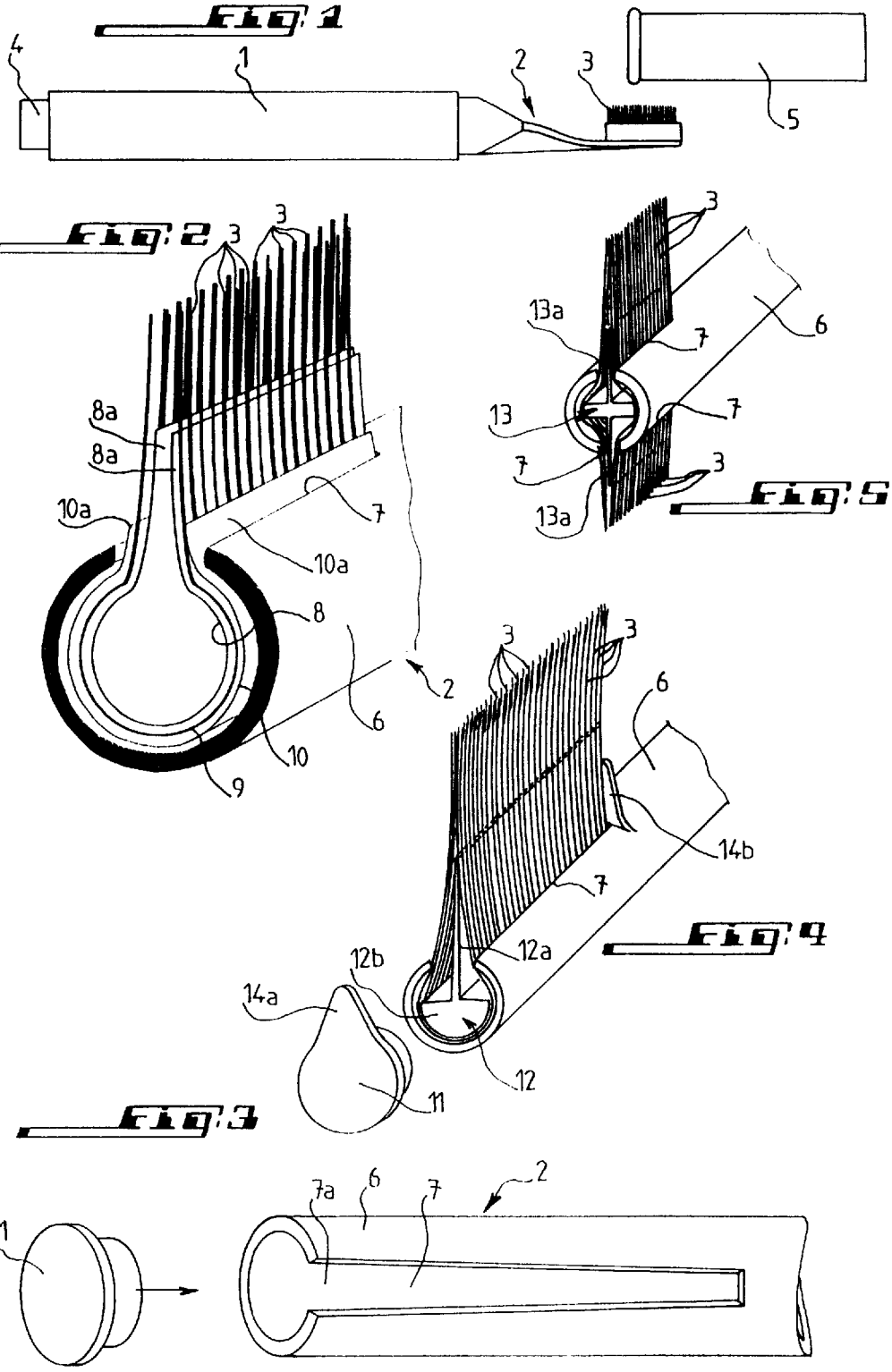
FIG. 1 is a side view of an embodiment of the brush according to the invention with the plug removed.
FIG. 2 is a partial perspective view in section of the stem carrying the bristles of the brush.
FIG. 3 is a partial top view of the stem alone with its associated plug.
FIG. 4 is a partial perspective view in section of another embodiment of the stem according to the principles of the invention.
FIG. 5 partially and perspectively illustrates also in section still another embodiment of the stem.

Referring more particularly to FIG. 1, one sees a brush which according to one exemplary embodiment consists essentially of a handle stick 1 extended by a stem 2 carrying at its end several lines or rows of bristles 3.

The handle stick 1 forms a tank for mascara for example and communicates through the stem 2 which is hollow with the roots of the bristles 3 so as to permit the application of mascara upon the lashes of the eye.

The tank 1 is provided at its end with a push-button 4 permitting to inject into the bristles 3 a determined amount of mascara whereas a plug 5 is provided to protect the bristles of the brush after the use of the latter.

According to another embodiment (not shown) and without departing from the scope of the invention, the plug 5 could constitute a tank for a product such as mascara so that in this case the handle stick 1 would constitute a mere means for gripping the brush. But this handle stick 1 could perfectly also itself form a tank containing a liquid for the dilution of the product to be applied, contained in the plug 5 for the protection of the brush.

Thus, in the case where the plug 5 would contain mascara, one could provide as a diluting liquid within the handle stick an aqueous medium which may contain various substances such as binders or treating agents.

According to the invention and referring in particular to FIGS. 2 and 3, the stem 2 carrying the bristles 3 consists of a preferably cylindrical tube 6 at the end of which is formed a slit 7 extending along one generatrix of this tube.

In the split tube 6 is housed an insert 8 itself also with a cylindrical shape as one sees it well on FIG. 2 and around which are applied flexible filaments 9 the free ends of which constituting the bristles 3 are projecting from the slit 7 of the tube 6.

According to a preferred embodiment, the filaments 9 are arranged about the insert 8 in the manner of closely joined whorls.

The filaments 9 forming these closely joined whorls are held around the insert 8 by a split envelope 10 which is interposed between the insert 8 and the split tube 6. One should remark here that such a split envelope 10 is not at all compulsory and could perfectly be omitted without departing from the scope of the invention.

According to the embodiment shown on FIGS. 2 and 3, the insert 8 exhibits the shape of a split cylinder the free mutually facing edges 8*a* of which project from the slit 7 of the tube 6. Thus the free edges 8*a* form bearing and orientation surfaces for the bristles 3 which form two sheets of bristles on either side of the free edges 8*a* as one sees it clearly on FIG. 2. Moreover both free edges 8*a* define a space therebetween from which mascara will escape for thus soaking the bristles 3, it being well understood that mascara coming from the tank within the handle 1 of the brush (see FIG. 1) passes into the duct formed by the lower cylindrical portion of the insert 8.

Reverting to the envelope 10 previously mentioned, one sees on FIG. 2 that it also exhibits substantially the shape of a split cylinder the free edges 10*a* of which, quite like the free edges 8*a* of the insert 8, are projecting from the slit 7 of the tube 6 but preferably along one smaller height than that of the free edges 8*a*. It is to be noted that the relative height between the free edges 8*a* and 10*a* could be variable according to the desired flexibility for the rows of bristles 3.

Thus, as one understands it, the free edges 10*a* reacting upon the edges of the slit 7 will in a way form a clamp applying the sheets of bristles 3 upon the free edges 8*a* of the insert 8.

As one sees it well on FIG. 3, the slit 7 of the tube 6 constituting the hollow stem of the brush exhibits a trapezoidal shape opening at the end of the tube and the wider portion 7*a* of which is located at this end of the tube which is opening and may be closed with a plug 11. Thus the plug 11 will hold within the tube 6 all the elements it contains, namely the assembly constituted by the insert 8 and the envelope 10 retaining the flexible filaments 9 forming the bristles 3.

The trapezoidal shape of the slit 7 of the tube 6 permits a better distribution of the product and regulates the flow rate over the whole length of the inert 8. Otherwise said, there is a compensation for the pressure loss from one end to the other one of the slit 7.

The insert may have another shape than that shown on FIG. 2 without therefor departing from the scope of the invention.

Thus, as one sees it on FIG. 4, one may use the insert 12 exhibiting the shape of a T-like piece the vertical leg 12*a* of which projects from the slit 7 of the tube 6.

Here in this case, the product, i.e. for example mascara, will be delivered to the bristles 3 of the brush by flowing between both spaces or ducts defined by the vertical leg 12*a* and the horizontal leg 12*b* on either side of the leg 12*a*. On FIG. 4, one has not shown the envelope 10 permitting to apply the bristles onto the insert 12, but such an envelope could perfectly be provided.

One should further remark here that the insert 12 may assume the shape of a closed and hollow structure as one sees it well on FIG. 4 but could also quite well assume the shape of a hollow and open structure at the level in particular of the horizontal leg 12*b*.

One further sees on FIG. 4 that the plug 11 at the end of the tube 6 comprises a lug 14*a* and likewise the tube 6 comprises a lug 14*b* radially projecting from the said tube at the level of the closed end of the slit 7. Thus the lugs 14*a* and 14*b* will advantageously close the side ends of the lines or rows of bristles 3 above the slit 7 and will avoid the escape of the product through these ends during the flow in the tube of the product which therefore will flow between the sheets of bristles 3 only.

On should remark that such lugs could be provided on the other embodiments of the brush according to this invention.

Referring to FIG. 5, one sees that the brush according to this invention may comprise opposite sheets of bristle, namely for example one sheet of long bristles 3 (upper part of FIG. 5) and one sheet of short bristles 3 (lower part of FIG. 5).

In this case, the split tube 6 will comprise two opposite slits such as 7 and the insert will exhibit in cross section as shown at 13 the shape of a cross both opposite arms 13*a* of which extend through the slit 7 between two sheets of bristles 3 to avoid the crossing of the bristles. In the embodiments previously described, the leg 12*a* of the insert 12 and the free edges 8*a* of the insert 8 also advantageously prevent the crossing of the bristles 3.

All the elements of the brush which have just been described may be made from any suitable synthetic material. There may also advantageously be provided the addition of an adhesive for a better securing of the bristles onto the insert within the split tube.

Figure 6:
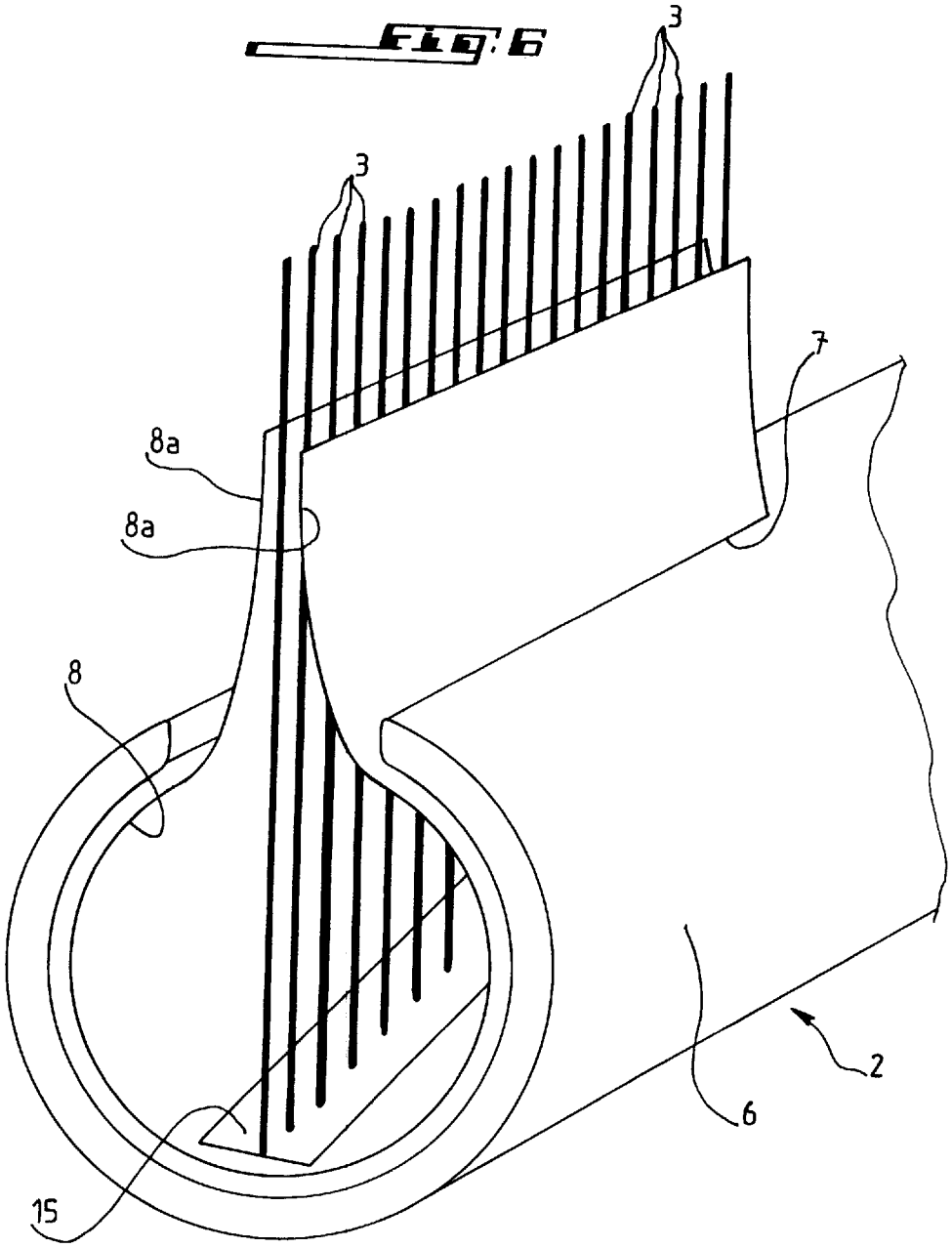
FIG. 6 is a partial perspective view in section of the stem carrying the bristles of the brush according to another embodiment of retaining the bristles.

In the embodiment shown on FIG. 6 and which is akin to that shown on FIG. 2, the bristles 3 are set inside of the insert or split cylinder 8 so as to project between the free mutually confronting edges 8*a* of the said insert. Thus, the bristles 3 are here set inside of the insert substantially oppositely to and at the level of the gap between the free edges 8*a* of the insert 8.

According to the example shown, the bristles 3 are set onto a plate or the like 15 made fast through adhesive bonding for example to the internal wall of the insert 8.

The invention is not at all limited to the described and illustrated embodiments which have been given by way of example only.

In this respect, it should be said that the brush according to this invention may be used to apply a viscous or other product of any nature upon any surface. One indeed understands that the structure of this brush does not at all limit its applications. This brush exhibits in particular a great interest for the application of cosmetic products presenting themselves in the shape of a compacted powder such as eyelid shades for example.

The invention therefore comprises all the technical equivalents of the means described as well as their combinations, if the latter are carried out according to its gist.

What is claimed is:

1. Brush for the application of a liquid or pasty product such for example as mascara and of the type comprising a stem (2) consisting of a tube (6) in which is formed a slit (7) extending along one generatrix of this tube and from which are projecting bristles (3) carried by an insert (8, 12, 13) accommodated in the said tube, characterized in that the tube (6) is connected to a handle stick (1) forming a product tank and in that the insert (8, 12, 13) assumes the shape of a duct around which are applied flexible filaments (9) the free ends of which projecting from the slit (7) of the tube constitute the bristles (3) of the brush adapted to be soaked with the product delivered by the said duct.

2. Brush according to claim 1, characterized in that the aforesaid filaments (9) are held about the insert by a split envelope (10) interposed between the insert and the tube (6).

3. Brush according to claim 1, characterized in that the insert (8) exhibits substantially the shape of a split cylinder the free mutually facing edges **(8*a*) of which are projecting from the slit (7) of the tube (6) to constitute bearing and orientation surfaces for the bristles (3)**.

4. Brush according to claim 1, characterized in that the insert (12) exhibits the shape of a T-like piece, the vertical leg **(12*a*) of which projects from the slit (7) of the tube (6)**.

5. Brush according to claim 1, characterized in that the slit (7) of the tube (6) has a trapezoidal shape diverging towards the free end of the tube (6).

6. Brush according to claim 2, characterized in that the aforesaid envelope (10) exhibits substantially the shape of a split cylinder the free mutually confronting edges **(10*a*) of which are projecting from the slit (7) of the tube (6) to clamp the bristles (3) between the said free edges (10*a*) and the free edges (8*a*) of the insert (8)**.

7. Brush according to claim 1, characterized in that the tube (6) is closed at its free end by a plug (11).

8. Brush according to claim 1, characterized in that it comprises two lugs **(14*a*, 14*b*) made fast to the plug (11) and to the tube (6), respectively, for closing the side ends of the rows of bristles (3) above the slit (7)** of the tube.

9. Brush for the application of a liquid or pasty product such for example as mascara and of the type comprising a stem (2) consisting of a tube (6) in which is formed a slit (7) extending along one generatrix of this tube and from which are projecting bristles (3) carried by an insert (8) housed within the said tube, characterized in that the tube (6) is connected to a handle stick (1) forming a product tank and in that the insert (8) assumes the shape of a split cylinder the free mutually facing edges **(8*a*) of which are projecting from the slit (7) of the tube (6) to constitute surfaces between which are projecting the bristles (3) which are set inside of the insert (8) substantially oppositely to and at the level of the said free edges (8*a*)**.

10. Brush according to claim 9, characterized in that the bristles (3) are set onto a plate or the like (15) made fast to the internal wall of the insert (8).

* * * * *